US008622610B2

(12) United States Patent
Tran et al.

(10) Patent No.: US 8,622,610 B2
(45) Date of Patent: Jan. 7, 2014

(54) INVERTER DEVICE FOR A TIMEPIECE MOVEMENT

(75) Inventors: Huy Van Tran, La Chaux-de-Fongs (CH); Ludovic Perez, Villers-le-Lac (FR)

(73) Assignee: Pequignet S.A., Morteau (FR)

( * ) Notice: Subject to any disclaimer, the term of this patent is extended or adjusted under 35 U.S.C. 154(b) by 20 days.

(21) Appl. No.: 13/391,149

(22) PCT Filed: Jun. 16, 2010

(86) PCT No.: PCT/EP2010/058498
§ 371 (c)(1),
(2), (4) Date: Feb. 17, 2012

(87) PCT Pub. No.: WO2010/146099
PCT Pub. Date: Dec. 23, 2010

(65) Prior Publication Data

US 2012/0176870 A1 Jul. 12, 2012

(30) Foreign Application Priority Data

Jun. 16, 2009 (EP) ..... 09162836

(51) Int. Cl.
*G04B 25/02* (2006.01)
*G04B 5/00* (2006.01)

(52) U.S. Cl.
USPC ..... 368/148; 368/207

(58) Field of Classification Search
USPC ..... 368/147, 148, 206–208
See application file for complete search history.

(56) References Cited

U.S. PATENT DOCUMENTS

| | | | | |
|---|---|---|---|---|
| 3,306,025 | A * | 2/1967 | Kocher | 368/148 |
| 3,620,337 | A * | 11/1971 | Fluck | 192/36 |
| 3,838,567 | A * | 10/1974 | Giger et al. | 368/208 |
| 2007/0237035 | A1 * | 10/2007 | Helfer et al. | 368/147 |

FOREIGN PATENT DOCUMENTS

| | | | |
|---|---|---|---|
| CH | 256922 | * | 3/1949 |
| CH | 331124 | * | 6/1958 |
| CH | 499801 | * | 8/1964 |

OTHER PUBLICATIONS

English translation of CH331124, retrived from the internet May 5, 2013.*

* cited by examiner

*Primary Examiner* — Vit W Miska
(74) *Attorney, Agent, or Firm* — Finnegan, Henderson, Farabow, Garrett & Dunner, LLP

(57) ABSTRACT

An inverter device for timepiece movements is disclosed which includes first and second toothed wheels intended to be driven in opposite rotation directions and coaxial with an output toothed member intended to be kinematically connected to a pivoting member of the timepiece movement. The wheels are connected to the output member by unidirectional transmission members adapted to transmit to the output member rotation in only the same one predefined rotation direction and to prevent the transmission of rotation of the output member in this predefined rotation direction to one or the other of the wheels. Each unidirectional transmission member includes two diametrically opposite teeth of asymmetrical shape and is connected to the output member in such a manner as to be constrained to rotate with it while being able to be moved between first and second extreme positions in a radial direction. Each wheel includes a plate provided with a central counterbore defining a housing for the corresponding unidirectional transmission member and the periphery of which includes n peripheral tips intended to cooperate with the teeth of the corresponding unidirectional transmission member in the predefined rotation direction, and each of which is defined by the intersection of a circular hole with the periphery, n being equal to or greater than one.

19 Claims, 5 Drawing Sheets

INVERTER DEVICE FOR A TIMEPIECE MOVEMENT

This application is a continuation application of prior International Application No. PCT/EP2010/058498, filed on Jun. 16, 2010 and claiming priority to European (EP) Patent Application No. 09162836.2, filed Jun. 16, 2009.

TECHNICAL FIELD

The present invention concerns an inverter device, intended to equip a timepiece movement, including first and second toothed wheels intended to be driven simultaneously in opposite rotation directions by a mechanism of the timepiece movement. The first and second wheels may both be coaxial with an output toothed member, intended to be connected kinematically to a pivoting member of the timepiece movement, and may be mechanically connected to the output member by first and second unidirectional transmission members, or pawls, respectively, adapted to transmit to the output member a rotation of one wheel or the other in the same single predefined rotation direction and to prevent the transmission of a rotation of the output member in the predefined rotation direction to one or the other of the wheels.

The present invention also concerns a timepiece movement comprising such an inverter device as well as a method of manufacturing such an inverter device.

BACKGROUND

Unidirectional transmission members and inverter devices are already routinely used in automatic winding timepiece movements, notably being disposed in the automatic winding train of the barrel spring. For example, different embodiments of such devices are described in pages 180 et seq of "Théorie d'horlogerie", by C.-A. Reymondin et al., published by Fédération des Ecoles Techniques (Suisse), ISBN 2-940025-10-X.

Two types of wheel are used in these devices, namely some intended to cooperate with a unidirectional transmission member in an axial direction and others intended to cooperate with a unidirectional transmission member in the general plane of the wheel. In the first case, the wheels have structures that are generally simpler than in the second case, but the corresponding devices have a larger overall size. However, when the cooperation between the wheel and the unidirectional transmission member occurs in the general plane of the wheel, it is necessary to machine detents or tips in the wheel, generally by complex milling operations, which can prove costly. This drawback is all the more of a problem when two wheels are necessary to produce an inverter device in the same timepiece movement.

Furthermore, the aforementioned work gives an example of an inverter device comprising two unidirectional transmission systems arranged one alongside the other, thus having a non-negligible overall size within the corresponding timepiece movement.

The patent CH 331124 gives an example of an inverter device in which two unidirectional transmission systems are arranged coaxially with each other to reduce the overall size of the inverter device. However, the structure of the components used in this device is complex and likewise their assembly.

Moreover, it will be noted that these devices are not generally used in the manual winding train, in which a clutch mechanism is generally used, to prevent rotation of the winding stem when the barrel is driven from the automatic winding mechanism.

SUMMARY

A principal object of the present invention is to alleviate the drawbacks of known prior art devices by proposing such a device the manufacture and assembly of which are simplified compared to known inverter devices, the resulting overall size being small compared to that of known inverters.

To this end, the present invention more particularly concerns an inverter device wherein each of the unidirectional transmission members may include two teeth that may be substantially diametrically opposite and may have asymmetrical shapes, and may be mechanically connected to the output member in such a manner as to be constrained to rotate therewith whilst being able to be moved between first and second extreme positions in a radial direction with reference to the output member. This inverter device may further be arranged such that each of the first and second wheels includes a plate, having a first radius R10, respectively R100, and is provided with peripheral teeth, as well as a central counterbore defining a housing for the corresponding unidirectional transmission member and the periphery of which includes n peripheral tips intended to cooperate with the teeth of the corresponding unidirectional transmission member in the predefined rotation direction, and each of which is defined by the intersection of a circular hole with the periphery, n being equal to or greater than one.

Thanks to these features, the inverter device of the present invention may be manufactured and assembled very easily and enables conversion of two opposite rotation movements of a timepiece mechanism into a single rotation movement of a mobile, in a predefined rotation direction, whilst having a small overall size relative to prior art inverter devices.

The inverter device may preferably be further arranged such that, for each of the first and second wheels, the central counterbore has a shape resulting from the combination of a substantially circular central main first hole having a second radius R20, respectively R200, with n secondary circular holes, having a third radius R30, respectively R300, less than the second radius R20 or R200, and the centers C30, C300 of which are situated at a distance from the center C10, C100 of the corresponding wheel greater than R20-R30, respectively R200-R300. Furthermore, each of the first and second wheels may preferably include n supplementary circular holes, having a fourth radius R40, respectively R400, less than the third radius R30 or R300, each of the n supplementary holes intersecting a portion of the periphery of the corresponding central counterbore defined by a single one of the secondary circular holes and each of the n supplementary holes having its center C40, C400 situated on a radius other than the radius passing through the center C30, C300 of the corresponding secondary hole, at a distance from the center C10, C100 of the corresponding wheel greater than the second radius R20, respectively R200, in such a manner as to define the tips.

Thus all machining of the part of each wheel that is intended to cooperate with the inverter member may be effected by simple operations, notably drilling operations, or even by milling operations of reduced complexity. In the context of the present disclosure, by "drilling" must be understood the operation of making a circular hole, which may be a blind hole or a through-hole, using a drilling tool exerting an action on the material to be machined in the direction of its rotation axis.

It will moreover be noted that the supplementary holes, use of which is not absolutely necessary to obtain the advantageous effects of the present invention, favor some smoothness of operation when a wheel acts on the corresponding unidirectional transmission member, to move it in a radial direction when the rotation movement of the wheel must not be retransmitted to the pivoting member via the associated unidirectional transmission member.

The first and second wheels may advantageously be disposed in such a manner that their respective counterbores face each other, the unidirectional transmission members being superposed.

The inverter device may preferably further comprise a central guide member adapted to constrain the output member and the unidirectional transmission members to rotate together. Moreover, the guide member may advantageously be fastened to the output member and comprise a bush, having two substantially parallel flats, adapted to cooperate with an opening provided in each of the unidirectional transmission members and having a width slightly greater than the distance separating the flats from each other and a length greater than the diameter of the bush, to enable the unidirectional transmission members to be moved relative to the bush guided by the flats.

The present invention also provides a method of manufacturing a wheel for such an inverter device or for a unidirectional transmission device, which may comprise the steps consisting of obtaining a plate having a first radius R1 and providing peripheral teeth on the plate, the method including the supplementary steps of:

forming a central counterbore in the plate and drilling n tips at the periphery of the central counterbore intended to cooperate with a unidirectional transmission member and each of which is defined by the intersection of a circular hole with the periphery, n being equal to or greater than one.

The central counterbore may advantageously be formed by machining a substantially circular central first main hole having a second radius R2, combined with machining n secondary circular holes, having a third radius R3 less than the second radius R2 and the centers C3 of which are situated at a distance from the center C1 of the wheel greater than R2-R3. The method may include a supplementary step consisting of machining n additional circular holes having a fourth radius R4 less than the third radius R3, each of the n supplementary holes intersecting a portion of the periphery of the central counterbore defined by a single one of the secondary circular holes and each of the n additional holes having its center C4 situated on a radius other than the radius passing through the center C3 of the corresponding secondary hole, at a distance from C1 greater than the second radius R2, in such a manner as to define the tips. The supplementary holes may be machined before the other holes.

The present invention further provides a timepiece movement including a unidirectional transmission device and/or an inverter device provided with such a wheel.

BRIEF DESCRIPTION OF THE DRAWINGS

Other features and advantages of the present invention will become more clearly apparent on reading the following detailed description of preferred embodiments given with reference to the appended drawings provided by way of non-limiting example and in which.

DETAILED DESCRIPTION

Figure 1:
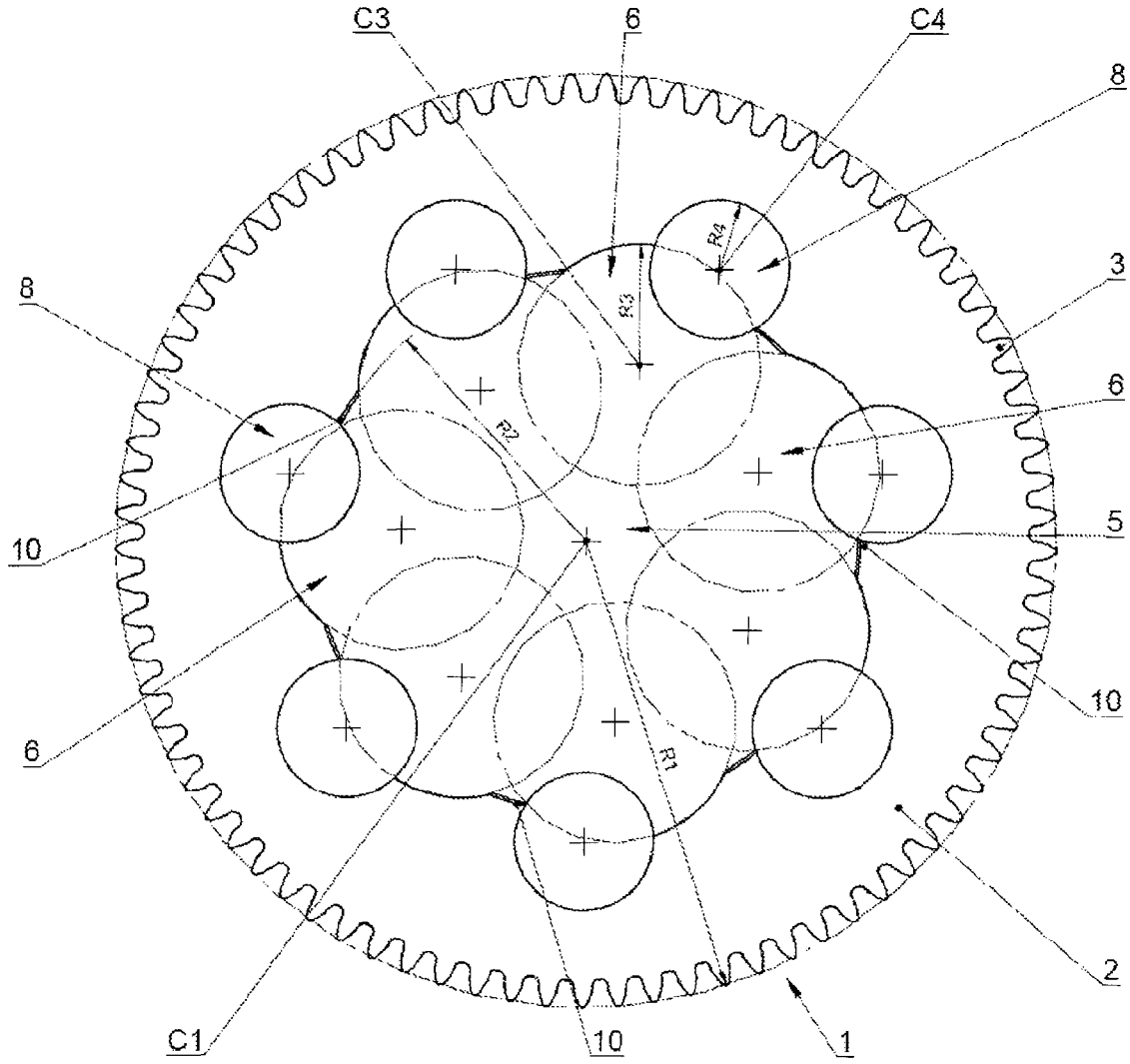
FIG. 1 is a simplified diagrammatic front view showing the manufacture of a wheel of a preferred embodiment of the present invention.

FIG. 1 shows diagrammatically the method of manufacturing a wheel 1 of a preferred embodiment of the present invention, such a wheel being intended to equip a unidirectional transmission device or an inverter device, notably to be integrated into a manual or automatic winding train of a timepiece movement of the automatic winding type.

The manufacturing process comprises the following steps, after obtaining a wheel plate 2, with center C1, having a first radius R1 and in which peripheral teeth 3 are produced.

A central counterbore 5 is produced, preferably by drilling with a second radius R2. A plurality of secondary circular holes 6 is produced by drilling operations, with a third radius R3, less than the second radius R2. The centers C3 of the secondary holes 6 are advantageously situated at a distance from the center C1 of the plate 2 greater than R2-R3. The secondary holes therefore intersect the periphery of the central counterbore 5.

There may be provision for n secondary holes to be drilled, n being greater than or equal to one.

A supplementary operation consists of drilling n supplementary circular holes 8 having a fourth radius R4 less than the third radius R3. Each of the additional holes 8 intersects a portion of the periphery of the central counterbore 5 defined by a single secondary hole 6, having its center C4 situated on a radius other than the radius passing through the center C3 of the corresponding secondary hole 6, at a distance from C1 greater than the second radius R2.

The intersection of each secondary hole 8 with the corresponding supplementary hole 6 defines a tip 10 intended to cooperate with a unidirectional transmission member, as will emerge from the detailed description of the subsequent figures.

The secondary and supplementary holes may be blind holes or through-holes without departing from the scope of the present invention.

It will be noted that the chronology of executing the steps that have just been described is liable to vary as a function of the locations and radii of the various holes to be drilled. It is easier to drill a hole if the location of its center is not devoid of material.

As an alternative to the method described above, it is possible to provide for the central counterbore 5 not to be produced by specific drilling but to be obtained directly by the production of the secondary holes 6, which preferably have, in this case, a sufficient radius for all of the material at the center of the plate to be removed after all of the secondary holes have been formed.

It emerges from the above description of the method that it is not necessary, as is the case in the prior art, to use complex and costly machining operations. Simple conventional drilling operations or milling operations of low complexity are sufficient to manufacture the wheel intended to equip an inverter device of the present invention.

Figure 2:
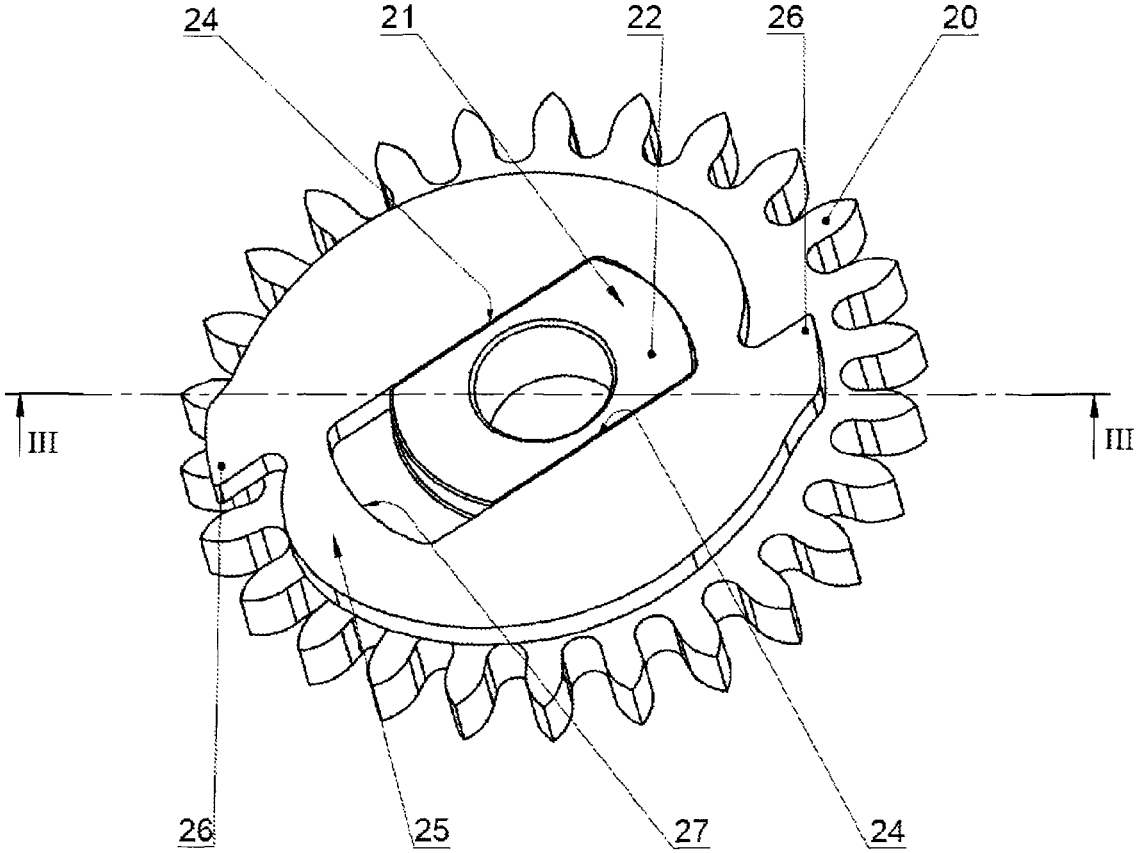
FIG. 2 is a simplified perspective view of part of an inverter device intended to cooperate with a wheel similar to that shown diagrammatically in FIG. 1.
Figure 3:
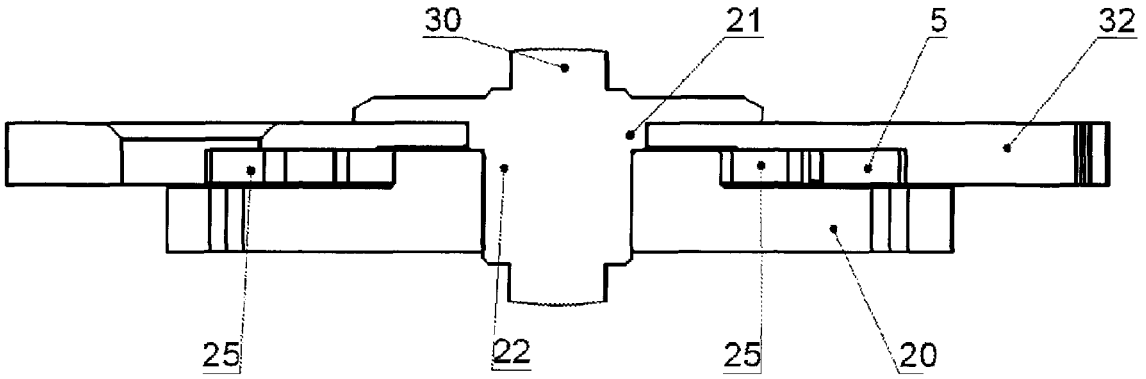
FIG. 3 is a simplified view of a unidirectional transmission device using the elements from FIG. 2 in section taken along the line III-III in FIG. 2.
Figure 4:
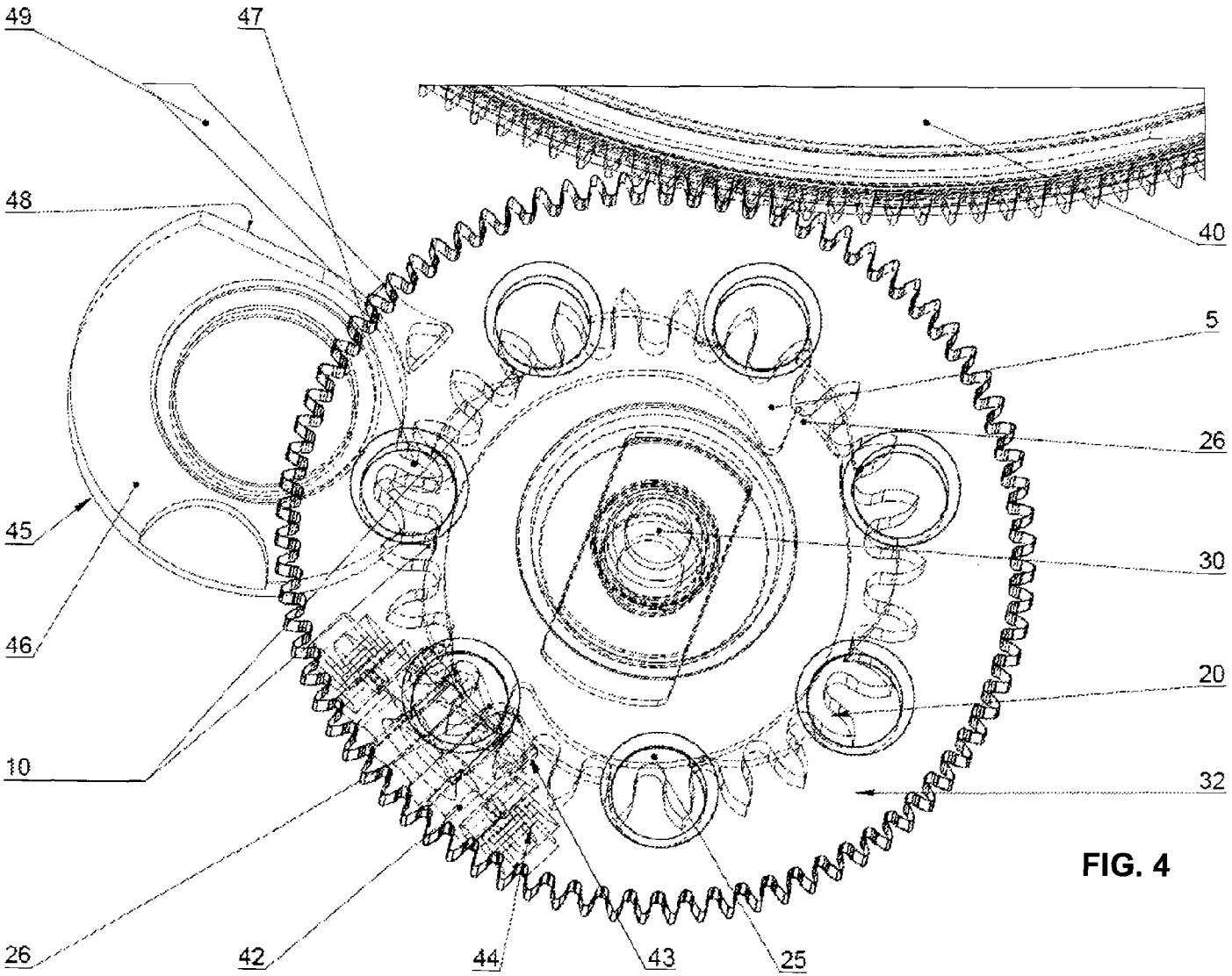
FIG. 4 is a simplified perspective view, partially as if transparent, of one example of use of the unidirectional transmission device from FIG. 3 is a timepiece movement.

FIGS. 2, 3 and 4 show all or part of a unidirectional transmission device incorporating a wheel similar to that which has just been described.

FIG. 2 is a simplified perspective view showing components of this device.

The unidirectional transmission device includes a first toothed wheel 20 having a central opening (not visible) in which is accommodated and to which is fastened a central connecting member 21.

The latter member comprises a bush 22 of cylindrical general shape on which two parallel flats 24 are produced.

A unidirectional transmission member 25, comprising two teeth 26 of asymmetrical shape, is engaged over the bush 22 by means of a central opening 27. Each tooth has a front side (in the active rotation direction) that is substantially radial and a rear side having a short substantially tangential portion followed by a gentle slope, itself followed by a long portion of substantially circular shape providing the connection to the next tooth.

The central opening has a substantially oblong shape with a width slightly greater than the distance separating the two flats 24 and a length greater than the diameter of the bush 22.

It is clear from FIG. 2 that the unidirectional transmission member is connected to the connecting member 21, and thus to the first wheel 20, in such manner that it is constrained to rotate with the first wheel, while it is able to be moved in a substantially radial direction relative to the axis of the latter wheel.

It will be noted that the preferred structure of the unidirectional transmission member as described and shown enables it to be manufactured by an extremely simple method. Such a member may advantageously be obtained by stamping.

FIG. 3 is a view in section of the unidirectional transmission device with the components described with reference to FIG. 2 assembled to a central shaft 30 for mounting the device on the frame (not shown) of a timepiece movement.

Furthermore, a second wheel 32 assembled to the other components is coaxial with the first wheel 20 and the shaft 30.

The second wheel 32 is obtained by the manufacturing method described above with reference to FIG. 1.

FIG. 4 is a simplified perspective view showing how the second wheel 32, which here comprises seven tips 10, cooperates with the unidirectional transmission member 25 and how the unidirectional transmission device may advantageously be used in a timepiece movement.

It is seen in FIG. 4 that the unidirectional transmission member 25 is accommodated in the central counterbore 5 of the second wheel and has dimensions such that its teeth 26 are able to cooperate with the tips 10 of the latter wheel To be more precise, it is clear that the asymmetrical shape of the teeth 26 has the consequence that a tooth may cooperate with a tip in only one direction of relative rotation between the unidirectional transmission member and the second wheel, namely when the latter is driven in rotation in the anticlockwise direction as shown in FIG. 4. Note further that cooperation between the unidirectional transmission member and the second wheel involves only one tooth at a time.

In the embodiment shown in FIG. 4, the unidirectional transmission device is used in a manual winding train of a timepiece movement of the automatic winding type, i.e. between the winding stem (not shown) and the barrel 40.

The winding stem is arranged in the conventional manner to drive a sliding pinion (not shown) intended to drive in rotation a mobile, here a winding pinion 42, via Breguet teeth 43.

The winding pinion meshes with the first wheel 20 of the unidirectional transmission device via supplementary teeth 44. The winding pinion 42 is driven in rotation only when the winding stem is turned in the clockwise direction (as seen from the outside toward the inside), because of the conventional orientation of the Breguet teeth.

The first wheel 20 is then driven in the anticlockwise rotation direction and because of this induces rotation of the unidirectional transmission member 25 in the same rotation direction.

This brings about the configuration of FIG. 4, in which a tooth 26 cooperates with a tip 10 of the second wheel 32 to drive the latter wheel in rotation in the same direction.

The drum of the barrel 40 is therefore driven in rotation in the clockwise direction to recharge its spring (not visible).

Moreover, it will be noted that a pawl 45 has been provided to cooperate with the first wheel 20. The pawl 45 includes a plate 46 provided with a single peripheral tooth 47 interengaged with the teeth of the first wheel 20. The plate 46 has a flat 48 on a portion of its periphery, against which a spring 49 bears, in such a manner as to retain the plate 46 in its angular position as shown in FIG. 4. Accordingly, on each stepwise movement of the first wheel 20 in the anticlockwise direction, the plate 46 turns by one step in the clockwise direction and is immediately returned to its initial position by the action of the spring 49. Consequently, when the winding stem is turned in the clockwise direction, an effect similar to that produced by a conventional ratchet is obtained.

Conversely, if the winding stem is turned in the anticlockwise direction, the sliding of the Breguet teeth produces a similar effect that is present in only some known timepiece calibers either of the manually wound type or of the automatically wound type, but in which no clutch device is provided in the winding train, as is the case for example of the 7750 caliber marketed by the Swiss company ETA S.A. Manufacture Horlogère Suisse. This ratchet effect, when present in both rotation directions of the winding stem, gives the wearer of the corresponding watch an impression of high quality when they wind it manually.

Moreover, the pawl 45 advantageously provides the additional function of a ratchet for the barrel drum. The diameter of the plate 46 on one of the sides of the single tooth 47 is equal to the diameter that it has at the level of the tooth, thus preventing rotation of the first wheel 20 in the clockwise rotation direction. Such a feature, notably combined with the location of the pawl 45, enables the efficiency of automatic winding to be improved given that the automatic winding mechanism does not need to overcome the force of the pawl 45 to wind the barrel spring, in contrast to prior art mechanisms, thanks to the provision of the unidirectional transmission device.

If manual winding is not used, the barrel spring may be recharged from the automatic winding mechanism. In this case, the drum of the barrel 40 is driven by the latter in the clockwise rotation direction.

This rotation movement of the barrel drum drives rotation of the second wheel 32 of the unidirectional transmission device in the anticlockwise direction. In this case, however, the tips 10 come into contact with the teeth 26 of the unidirectional transmission member on their inactive side, with the inclined side of the teeth. Thus not only does the second wheel 32 not drive the unidirectional transmission member 25 in rotation, but it pushes it back so that it is moved on the bush 22. If the second wheel 32 turns for a certain time, the unidirectional transmission member effects to-and-fro movements between its two extreme positions, its teeth being alternately pushed back by the rear sides of the tips 10.

Thus the rotation movement of the second wheel 32 in the anticlockwise rotation direction is not transmitted to the first wheel 20, which remains stationary.

It is therefore seen that this unidirectional transmission device has the same function as prior art clutch devices, possibly in a more efficient manner because the inversion effect is instantaneous, in contrast to some of those clutch devices (notably those not including a spring).

Figure 5:
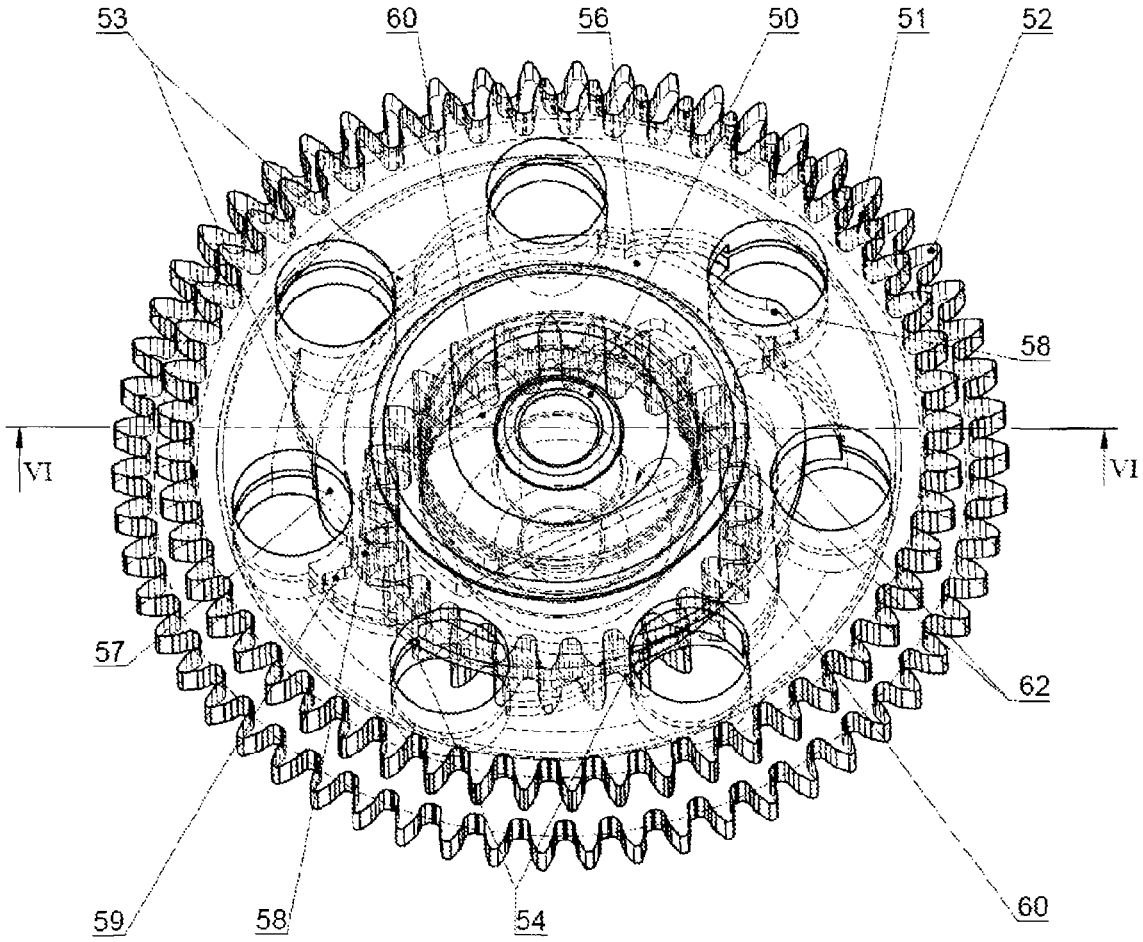
FIG. 5 is a simplified perspective view, partly as if transparent, of an inverter device of a preferred embodiment of the present invention.
Figure 6:
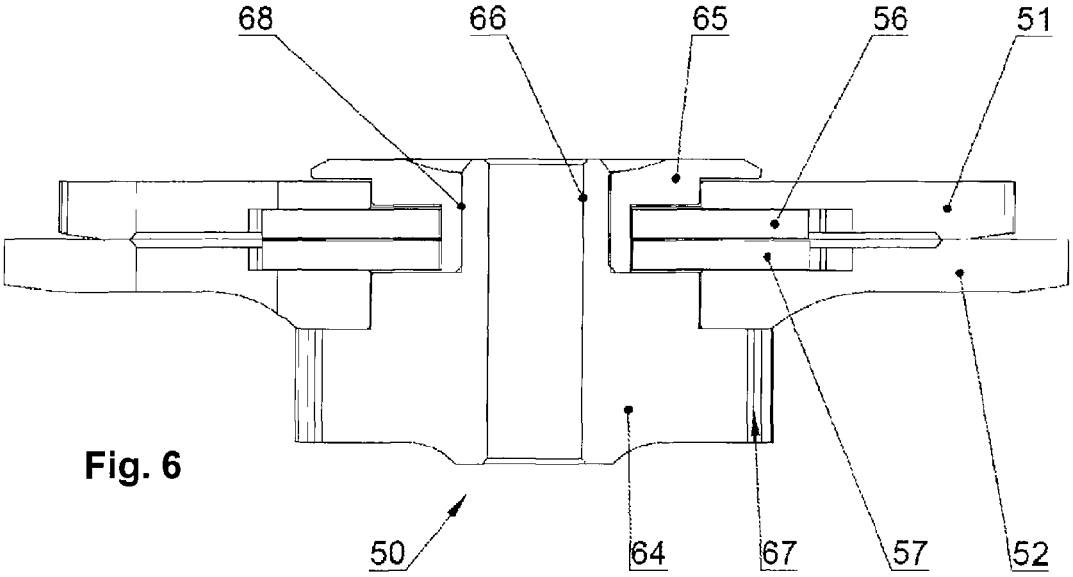
FIG. 6 is a simplified view of the inverter device from FIG. 5 in section taken along the line VI-VI in FIG. 5.
Figure 7:
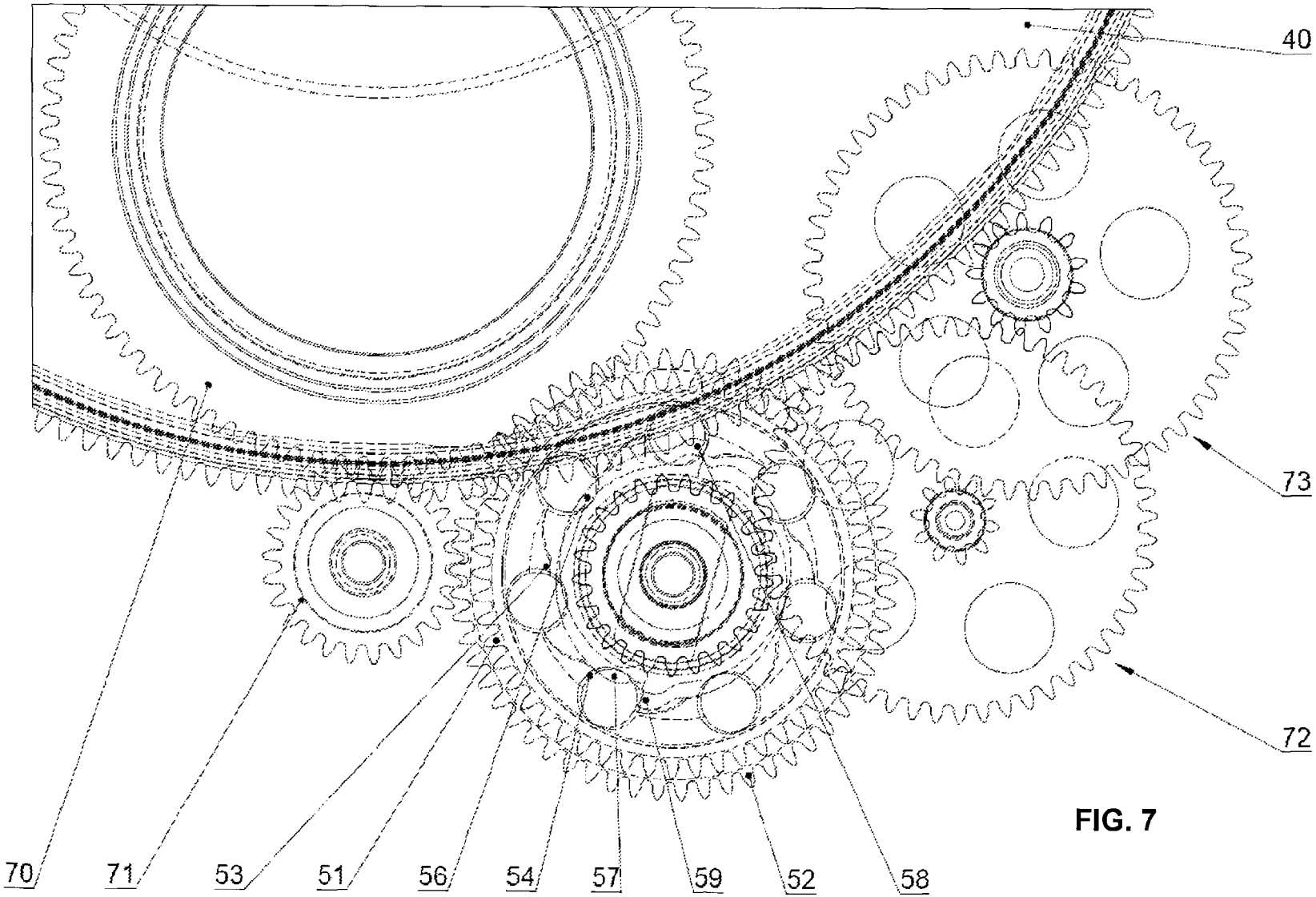
FIG. 7 is a simplified front view, partially as if transparent, of one example of use of the inverter device from FIG. 5 in a timepiece movement.

FIGS. 5 to 7 show an inverter device of a preferred embodiment of the present invention using two wheels of the type the manufacturing method for which is described above, with reference to FIG. 1.

FIG. 5 is a simplified perspective view, partially as if transparent, of that inverter device.

The latter device includes a central shaft 50 on which are mounted, free to rotate, two wheels 51 and 52 of the type for which the manufacturing process is described above, with reference to FIG. 1, that is to say each comprising a central counterbore on the periphery of which tips 53, 54 are provided.

The wheels 51 and 52 are superposed and adjacent, first and second unidirectional transmission members 56, 57 being accommodated in their respective central counterbores. Each of the unidirectional transmission members is similar to that described above, with reference to FIG. 2, that is to say it includes two teeth 58, 59 intended to cooperate with the tips 53 or 54 of the wheel with which it is associated.

It will further be noted that one of the two unidirectional transmission members may advantageously include a plurality of bosses (at least two, not shown), which may be formed by punches when it is stamped, for example, to reduce the area of contact between the two members and prevent them sticking to each other.

The central shaft 50 has a section provided with two substantially parallel flats 60 intended to define guide surfaces for central openings 62 provided in the unidirectional transmission members. Accordingly, the latter members are adapted to be moved in a radial direction with reference to the central shaft 50, as described above, with reference to the first embodiment.

It is clear from FIG. 5 that the two unidirectional transmission members 56, 57 and the wheels 51, 52 are arranged in such a manner that each wheel drives its unidirectional transmission member only when it turns in the anticlockwise rotation direction.

Conversely, when the wheels 51 and 52 are driven in the clockwise rotation direction, the tips 53, 54 slide over the teeth 58, 59 without driving the unidirectional transmission members in rotation, but forcing them to effect a to-and-fro movement between their two extreme positions along the flats 60.

It will be noted with reference to FIG. 5 that the two wheel plus unidirectional transmission member assemblies are the same way up.

FIG. 6 is a simplified view of the inverter device from FIG. 5 in section taken along the line VI-VI in FIG. 5, from which it is seen that the central shaft 50 comprises two components, namely a main shaft 64 and a guide member 65 in which the flats 60 are provided.

The main shaft is intended for fastening the inverter device to an element of the frame of the timepiece movement for which it is intended by means of a central bore 66. Moreover, it includes a pinion 67 intended to form an output member of the inverter device, as will become clearer from the detailed description of FIG. 7.

Of course, without departing from the scope of the invention it is possible for the main shaft to carry directly pivots for mounting on the frame of the timepiece movement in place of the central bore 66.

It will be noted that assembling the inverter device of the present invention is very simple. It suffices to place the first wheel 51 on the guide member 65, then the two unidirectional transmission members 56 and 57, then the second wheel 52, before inserting the main shaft 64 in an appropriate hole 68 in the guide member, to fasten these two elements together.

Of course, without departing from the scope of the invention the person skilled in the art could provide the flats 60 directly on the central shaft 64. The latter shaft would then provide the guide member function, while the element 65 would then have a shorter bush and simply ensure that the various components are held assembled to each other.

The operation of this inverter device is described next, with reference to FIG. 7, which is a simplified front view, partially as if transparent, of an example of the use of the inverter device from FIG. 5 in a timepiece movement.

The wheels 51, 52 are intended to be connected to an automatic winding device to be driven in rotation by the movements of an oscillating mass (not shown for reasons of clarity).

To be more precise, the first wheel 51 meshes directly with an automatic winding wheel 70 which is connected directly or indirectly to an oscillating mass.

The second wheel 52 meshes with the wheel 70 via a setting wheel 71, so as to turn in the opposite rotation direction to the first wheel at all times.

The output member of the inverter device, i.e. the pinion 67 of the main shaft 64, meshes with a first mobile 72 of an automatic winding train, the first mobile meshing with a second mobile 73, itself interengaged with the drum of the barrel 40.

As indicated above, rotation of either of the wheels 51, 52 in the anticlockwise direction drives rotation of the corresponding unidirectional transmission member in the same rotation direction, while rotation of the wheel in the clockwise direction does not drive the unidirectional transmission member.

When one of the unidirectional transmission members is driven in rotation (and thus necessarily in the anticlockwise direction in the embodiment shown) it induces an identical movement of the output member of the device, namely the pinion 67.

Accordingly, when the wheel 70 is driven in the clockwise rotation direction by the oscillating mass, it induces rotation in the same direction of the second wheel 52 and anticlockwise rotation of the first wheel 51. In this case, the tips 54 of the second wheel slide on the teeth 59 of the corresponding unidirectional transmission member 57, while one of the tips 53 of the first wheel snags one of the teeth 58 of the corresponding unidirectional transmission member 56 to drive it in rotation.

Consequently, clockwise rotation of the wheel 70 drives anticlockwise rotation of the output pinion 67 of the inverter device of the present invention via the first wheel 51.

Conversely, when the wheel 70 is driven in the anticlockwise rotation direction by the oscillating mass, it induces rotation in the same direction of the second wheel 52 and clockwise rotation of the first wheel 51. In this case, one of the tips 54 of the second wheel snags one of the teeth 59 of the corresponding unidirectional transmission member 57 to drive it in rotation and the tips 53 of the first wheel slide on the teeth 58 of the corresponding unidirectional transmission member 56.

Consequently, anticlockwise rotation of the wheel 70 also drives anticlockwise rotation of the output pinion 67 of the inverter device of the present invention via the second wheel 52.

Consequently, the inverter device of the present invention exploits rotation of the oscillating mass, regardless of its rotation direction, to recharge the barrel spring.

It will further be noted that the inverter device of the present invention also enables prevention of rotation of the barrel drum in the direction of discharging the barrel spring. In this case, the two wheels 51 and 52 are driven in the same rotation direction and tend to drive the wheel 70 in the opposite rotation direction because of the setting wheel 71, the consequence of which is to immobilize them. Thus it is not necessary to provide a pawl for the barrel drum.

It will be noted that the very simple structure of this device has the advantage of limiting its overall size compared to known prior art devices of this type. Furthermore, the small number of its components also renders its manufacture advantageous compared to known devices, enabling a significant reduction in manufacturing costs.

The foregoing description is intended to describe particular embodiments by way of nonlimiting illustration and the invention is not limited to the use of certain particular features that have just been described, for example the number of holes provided in the wheels shown and described, the number of teeth of the unidirectional transmission members, or the rotation directions referred to.

It will be noted that, according to the present invention, the wheel may simply be produced by providing the substantially circular central counterbore and then by drilling a single series of supplementary holes at its periphery, to define the tips intended to cooperate with a unidirectional transmission member. Even if such a solution is less efficacious than the preferred embodiment, it may prove sufficient.

The person skilled in the art will encounter no particular difficulty in adapting the content of the present disclosure to its own requirements by using a wheel, an inverter device or a timepiece movement different from the embodiments described here, but in which the wheel includes a central counterbore the periphery of which has n peripheral tips intended to cooperate with a unidirectional transmission member and each of which is defined by the intersection of two circular holes, n being greater than or equal to one, without departing from the scope of the present invention. It will be noted that the unidirectional transmission device and the inverter device described may be used independently of each other or in combination in the same timepiece movement, and even with a timepiece mechanism other than the winding mechanism, notably a complication calling for a single direction of rotation of a wheel.

The invention claimed is:

1. An inverter device, intended to equip a timepiece movement, including first and second toothed wheels intended to be driven simultaneously in opposite rotation directions by a mechanism of the timepiece movement, said first and second wheels both being coaxial with an output toothed member, intended to be kinematically connected to a pivoting member of the timepiece movement, and are mechanically connected to said output member by first and second unidirectional transmission members, respectively, adapted to transmit to said output member rotation of one wheel or the other in a single predefined rotation direction and to prevent the transmission of rotation of said output member, in said predefined rotation direction, to one or the other of said wheels, wherein each of said unidirectional transmission members includes two teeth that are substantially diametrically opposite and have asymmetrical shapes, and is mechanically connected to said output member in such a manner as to be constrained to rotate therewith whilst being able to be moved between first and second extreme positions in a radial direction with reference to said output member, wherein each of said first and second wheels includes a plate, having a first radius R10, respectively R100, and provided with peripheral teeth, as well as a central counterbore defining a housing for the corresponding unidirectional transmission member and the periphery of which includes n peripheral tips intended to cooperate with said teeth of said corresponding unidirectional transmission member in said predefined rotation direction, and each of which is defined by the intersection of a circular hole with said periphery, n being equal to or greater than one.

2. The device of claim 1, wherein, for each of said first and second wheels, said central counterbore has a shape resulting from the combination of a substantially circular central main first hole having a second radius R20, respectively R200, with n secondary circular holes, having a third radius R30, respectively R300, less than said second radius R20 or R200, and the centers C30, C300 of which are situated at a distance from the center C10, C100 of the corresponding wheel greater than R20-R30, respectively R200-R300, and wherein each of said first and second wheels further includes n supplementary circular holes, having a fourth radius R40, respectively R400, less than said third radius R30 or R300, each of said n supplementary holes intersecting a portion of the periphery of said corresponding central counterbore defined by a single one of said secondary circular holes and each of said n supplementary holes having its center C40, C400 situated on a radius other than the radius passing through the center C30, C300 of the corresponding secondary hole, at a distance from the center C10, C100 of the corresponding wheel greater than the second radius R20, respectively R200, in such a manner as to define said tips.

3. The device of claim 1, wherein said first and second wheels are disposed in such a manner that their respective counterbores face each other, said unidirectional transmission members being superposed.

4. The device of claim 1, further comprising a central guide member adapted to constrain said output member and said unidirectional transmission members to rotate together, said guide member being fastened to said output member and comprising a bush, having two substantially parallel flats, adapted to cooperate with an opening provided in each of said unidirectional transmission members and having a width slightly greater than the distance separating said flats from each other and a length greater than the diameter of said bush, to enable said unidirectional transmission members to be moved relative to said bush guided by said flats.

5. The device of claim 1, wherein it is intended to equip an automatic winding timepiece movement, said pivoting member being a barrel.

6. The device of claim 2, wherein said first and second wheels are disposed in such a manner that their respective counterbores face each other, said unidirectional transmission members being superposed.

7. The device of claim 2, further comprising a central guide member adapted to constrain said output member and said unidirectional transmission members to rotate together, said guide member being fastened to said output member and comprising a bush, having two substantially parallel flats, adapted to cooperate with an opening provided in each of said unidirectional transmission members and having a width slightly greater than the distance separating said flats from each other and a length greater than the diameter of said bush, to enable said unidirectional transmission members to be moved relative to said bush guided by said flats.

8. The device of claim 3, further comprising a central guide member adapted to constrain said output member and said unidirectional transmission members to rotate together, said guide member being fastened to said output member and comprising a bush, having two substantially parallel flats, adapted to cooperate with an opening provided in each of said unidirectional transmission members and having a width slightly greater than the distance separating said flats from each other and a length greater than the diameter of said bush, to enable said unidirectional transmission members to be moved relative to said bush guided by said flats.

9. The device of claim 6, further comprising a central guide member adapted to constrain said output member and said unidirectional transmission members to rotate together, said guide member being fastened to said output member and comprising a bush, having two substantially parallel flats, adapted to cooperate with an opening provided in each of said unidirectional transmission members and having a width slightly greater than the distance separating said flats from each other and a length greater than the diameter of said bush, to enable said unidirectional transmission members to be moved relative to said bush guided by said flats.

10. The device of claim 2, wherein it is intended to equip an automatic winding timepiece movement, said pivoting member being a barrel.

11. The device of claim 3, wherein it is intended to equip an automatic winding timepiece movement, said pivoting member being a barrel.

12. The device of claim 4, wherein it is intended to equip an automatic winding timepiece movement, said pivoting member being a barrel.

13. The device of claim 6, wherein it is intended to equip an automatic winding timepiece movement, said pivoting member being a barrel.

14. The device of claim 7, wherein it is intended to equip an automatic winding timepiece movement, said pivoting member being a barrel.

15. The device of claim 8, wherein it is intended to equip an automatic winding timepiece movement, said pivoting member being a barrel.

16. The device of claim 9, wherein it is intended to equip an automatic winding timepiece movement, said pivoting member being a barrel.

17. A method of manufacturing a wheel for a unidirectional transmission device or for an inverter device intended to equip a timepiece movement, comprising the steps consisting of obtaining a plate having a first radius R1 and providing peripheral teeth on said plate, further including the supplementary steps of:

forming a central counterbore in said plate, by machining a substantially circular central first main hole having a second radius R2, combined with machining n secondary circular holes, having a third radius R3 less than the second radius R2 and the centers C3 of which are situated at a distance from the center C1 of the wheel greater than R2-R3, and drilling n tips at the periphery of said central counterbore intended to cooperate with a unidirectional transmission member and each of which is defined by the intersection of a supplementary circular hole with said periphery, n being equal to or greater than one, by machining n supplementary circular holes having a fourth radius R4 less than said third radius R3, each of said n supplementary holes intersecting a portion of the periphery of said central counterbore defined by a single one of said secondary circular holes and each of said n supplementary holes having its center C4 situated on a radius other than the radius passing through the center C3 of the corresponding secondary hole, at a distance from C1 greater than said second radius R2, in such a manner as to define said tips.

18. An automatic winding type timepiece movement, including an inverter device including first and second toothed wheels intended to be driven simultaneously in opposite rotation directions by a mechanism of the timepiece movement, said first and second wheels both being coaxial with an output toothed member, intended to be kinematically connected to a pivoting member of the timepiece movement, and are mechanically connected to said output member by first and second unidirectional transmission members, respectively, adapted to transmit to said output member rotation of one wheel or the other in a single predefined rotation direction and to prevent the transmission of rotation of said output member, in said predefined rotation direction, to one or the other of said wheels, wherein each of said unidirectional transmission members includes two teeth that are substantially diametrically opposite and have asymmetrical shapes, and is mechanically connected to said output member in such a manner as to be constrained to rotate therewith whilst being able to be moved between first and second extreme positions in a radial direction with reference to said output member, wherein each of said first and second wheels includes a plate, having a first radius R10, respectively R100, and provided with peripheral teeth, as well as a central counterbore defining a housing for the corresponding unidirectional transmission member and the periphery of which includes n peripheral tips intended to cooperate with said teeth of said corresponding unidirectional transmission member in said predefined rotation direction, and each of which is defined by the intersection of a circular hole with said periphery, n being equal to or greater than one, the timepiece movement comprising on the one hand a manual winding train operated by a winding stem and on the other hand an automatic winding mechanism for recharging a barrel spring accommodated in a barrel, wherein said first and second toothed wheels of said inverter device are intended to be driven simultaneously in opposite rotation directions by said automatic winding mechanism, said toothed output member being intended to be kinematically connected to said barrel.

19. The timepiece movement of claim 18, said unidirectional transmission device being provided in said manual winding train of the timepiece movement.

* * * * *